United States Patent [19]

Wyss

[11] 4,047,487

[45] Sept. 13, 1977

[54] TOWING MECHANISM FOR A SKI LIFT

[76] Inventor: Samuel G. Wyss, Sporthaus, 3801 Kleine Scheidegg, Berne, Switzerland

[21] Appl. No.: 713,111

[22] Filed: Aug. 10, 1976

[30] Foreign Application Priority Data

Aug. 22, 1975 Switzerland ..... 10930/75

[51] Int. Cl.[2] ..... B61B 11/00

[52] U.S. Cl. ..... 104/173 ST; 242/107.3; 254/160; 267/64 R

[58] Field of Search ..... 104/173; 242/107.3, 242/156; 254/157, 158, 159, 160, 168, 186 R; 267/64 R; 92/134, 143; 91/443

[56] References Cited

U.S. PATENT DOCUMENTS

| | | | |
|---|---|---|---|
| 3,041,044 | 6/1962 | Nixon | 242/107.3 X |
| 3,286,311 | 11/1966 | Rhoads | 91/443 |
| 3,527,452 | 9/1970 | Hausenblas et al. | 267/64 R X |
| 3,595,528 | 7/1971 | Virkki | 254/160 |
| 3,907,256 | 9/1975 | Kankkunen | 254/160 |

FOREIGN PATENT DOCUMENTS

| | | | |
|---|---|---|---|
| 481,106 | 2/1952 | Canada | 242/107.3 |
| 1,280,907 | 10/1968 | Germany | 104/173 |
| 283,080 | 1/1928 | United Kingdom | 254/160 |

*Primary Examiner*—Robert J. Spar
*Assistant Examiner*—Randolph A. Reese
*Attorney, Agent, or Firm*—Steinberg & Blake

[57] ABSTRACT

A towing mechanism for a ski lift includes a pay-out and take-up device for a tow rope having a towing bar attached to it. That device has a housing in which a luffing drum is non-displaceably mounted for rotation; a nut secured to this drum cooperates with a screw-spindle in the manner of a non-self-locking screw gear. A piston secured to one end of the screw-spindle operates in a cylinder secured to the housing and connected, via a check valve and an adjustable throttle valve arranged in parallel with each other, to a liquid containing chamber which within a reservoir is separated by a dilatable diaphragm from a chamber containing pressurized gas.

3 Claims, 2 Drawing Figures

TOWING MECHANISM FOR A SKI LIFT

This invention relates to a towing mechanism for a ski lift having a hauling cable, of the type comprising a tow rope secured to a towing bar, a pay-out and take-up device enabling the tow rope to be pulled out and retracted, a suspension bar for connecting the pay-out and take-up device to the hauling cable, and return means for counteracting pay-out traction on the tow rope.

In a known towing mechanism such as that described in Swiss Patent No. 502,214, the device for paying out and taking up the tow rope is disposed in a housing and comprises a luffing drum connected to a spiral spring which turns the drum back and winds the pulled-out tow rope up on the luffing drum whenever there is no load on the towing bar secured to the outer end of the tow rope. The luffing drum is connected to at least one fly weight on which a brake shoe, pivotable between two end positions, is disposed in such a way that the braking effect is stronger when the tow rope is being pulled out than when it is being retracted in the absence of any load on the towing bar. When the tow rope is rapidly unwound from the rope-drum, the brake shoe pivots into its first end position, in which it acts upon the inner wall of the housing, designed as a brake drum, with less leverage than when the tow rope is being wound up on the drum.

Other towing mechanisms are disclosed in Swiss Pat. Nos. 443,391, 495,239 and 551,895. All of these designs feature a luffing drum connected to a spiral-shaped return spring which is wound when the tow rope is pulled out. As soon as no more traction is being exerted on the tow rope, the spring causes the rope-drum to turn in the opposite direction, thus winding the tow rope up again. There is also a braking device which acts upon the drum as a function of the latter's speed of rotation. The result is a controlled unwinding and rewinding of the tow rope on the luffing drum.

A drawback of all these known towing mechanisms is that the braking device requires a relatively great amount of maintenance, and in particular, there is substantial wear and tear on the brake linings. Moreoever, the spiral-shaped return springs are subject to a great deal of stress and tend to break quite frequently.

It is an object of this invention to provide a towing mechanism of the aforementioned type which requires less maintenance for its operation than do the prior art mechanisms, and which comprises return means less subject to breakdown.

To this end, in the towing mechanism according to the present invention, the pay-out and take-up device comprises a housing, a luffing drum non-displaceably mounted for rotation within the housing, a nut rigidly secured to the luffing drum, a screw-spindle non-rotatingly mounted for longitudinal displacement within the housing, the nut and the screw-spindle together forming a non-self-locking screw gear, and a hydraulic-pneumatic device including a piston rigidly secured to the screw-spindle for returning the screw-spindle after longitudinal displacement thereof.

In a preferred embodiment of the invention, the piston of the hydraulic-pneumatic return device is designed to operate in a cylinder secured to the housing; the pressure chamber of the cylinder, containing hydraulic fluid, is connected to a reservoir containing pressurized gas, preferably via a check valve and an adjustable throttle valve, in such a way that the check valve facilitates pulling-out of the tow rope and the throttle valve brakes retraction of the tow rope.

This preferred embodiment of the invention will now be described in detail with reference to the accompanying drawing, in which.

Figure 1:
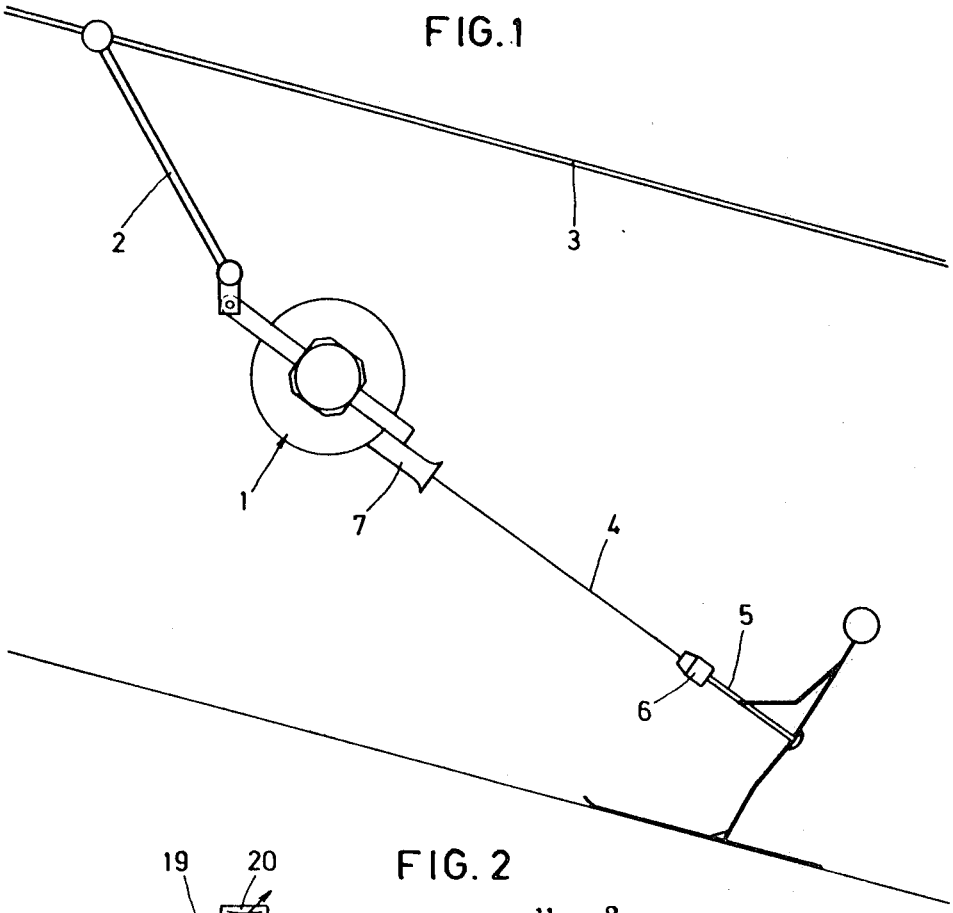
FIG. 1 is a diagrammatic view of the towing mechanism.

FIG. 1 shows a towing mechanism 1 connected by means of a suspension bar 2 to a hauling cable 3 of a ski lift, not otherwise shown. Secured to the outer end of a tow rope 4 pulled out of mechanism 1 is a towing bar 5, by means of which a skier is pulled up the slope. When the skier arrives at the top, he releases towing bar 5, and tow rope 4 is retracted by mechanism 1, in a manner to be described below, until a thickened end portion 6 of towing bar 5 comes up against a funnel-shaped part 7 of mechanism 1.

Figure 2:
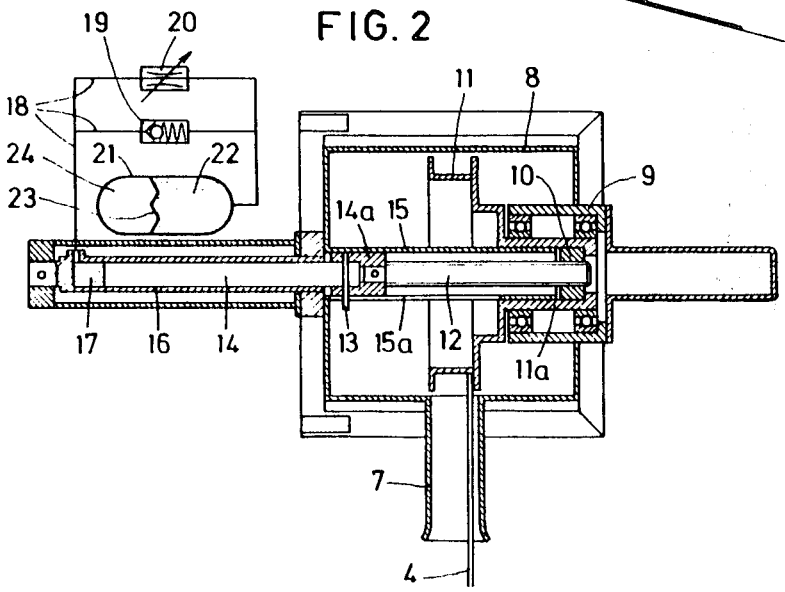
FIG. 2 is a section through the main part of the towing mechanism.

As may be seen in FIG. 2, a housing 8, which may, for example, be constructed mainly of tubes welded together, has a bearing 9 in which the hub 11*a* of a luffing drum 11 is non-displaceably mounted for rotation. A nut 10 fitted tightly in hub 11*a* runs on a multi-thread, e.g., four-thread, screw-spindle 12, thus forming with the latter a non-self-locking screw gear. Nut 10 may take the form of a low friction nut having an endless series of circulating balls. The left-hand end of screw-spindle 12, as viewed in FIG. 2, is tightly seated by means of a crossbolt 13 in the thickened head 14*a* of a piston 14. In order to prevent screw-spindle 12 from rotating, one end of crossbolt 13 runs in a longitudinal slot 15*a* made in a sleeve 15 which is secured to housing 8 and guides head 14*a.* Piston 14 operates in a cylinder 16 secured to housing 8. A pressure chamber 17 of cylinder 16 communicates via pipes 18, a check valve 19, and an adjustable throttle valve 20, which is connected in parallel to check valve 19, with a chamber 22 of a pressure reservoir 21, within which there is also a chamber 24, filled with pressurized gas and separated from chamber 22 by an elastically dilatable diaphragm 23. In operation, when tow rope 4 is pulled out, drum 11 is rotated, together with nut 10, in such a way that screw-spindle 12 is displaced toward the left, as viewed in FIG. 2, together with piston 14. Piston 14 thereupon forces liquid out of chamber 17 of cylinder 16 through check valve 19 into chamber 22 of pressure reservoir 21, in chamber 24 of which the pressurized gas is still further compressed.

For retraction of tow rope 4, this pressurized gas causes an adjustable return flow of liquid from chamber 22 through adjustable throttle valve 20 into chamber 17 of cylinder 16. Piston 14 then moves toward the right, as viewed in FIG. 2, its rate of movement being faster or slower depending upon the abundance of the return flow, and tow rope 4 is therefore rewound on drum 11 at a faster or slower rate accordingly.

In FIG. 1, the common axis of screw-spindle 12 and piston 14 runs perpendicular to the approximately vertical plane containing tow rope 4. However, the arrangement might equally well be one in which this axis (possibly with a certain inclination) would be contained in that plane.

What is claimed is:

1. A towing mechanism for a ski lift having a hauling cable, of the type comprising a tow rope secured to a towing bar, a pay-out and take-up device enabling said tow rope to be pulled out and retracted, a suspension bar for connecting said device to said cable, and return means for counteracting pay-out traction on said tow rope, wherein said pay-out and take-up device comprises:

a housing, a luffing drum non-displaceably mounted for rotation within said housing, a nut rigidly secured to said rope-drum, a screw-spindle non-rotatingly mounted for longitudinal displacement within said housing, said nut and said screw-spindle together forming a non-self-locking screw gear, and a hydraulic-pneumatic device including a piston rigidly secured to said screw-spindle for returning said screw-spindle after longitudinal displacement thereof.

2. The towing mechanism of claim 1, wherein said hydraulic-pneumatic device further includes a reservoir containing a pressurized gas and a cylinder secured to said housing and comprising a pressure chamber containing hydraulic fluid, said piston operating within said cylinder, and said pressure chamber communicating with said reservoir.

3. The towing mechanism of claim 2, wherein said hydraulic-pneumatic device further includes a check valve and an adjustable throttle valve, said pressure chamber communicating with said reservoir via said check valve and said throttle valve in such a way that said check valve facilitates pulling-out of said tow rope and said throttle valve brakes retraction of said tow rope.

* * * * *